US006976482B2

(12) United States Patent
Bittner

(10) Patent No.: US 6,976,482 B2
(45) Date of Patent: Dec. 20, 2005

(54) ELECTRONIC IGNITION SYSTEM FOR VINTAGE AUTOMOBILES

(76) Inventor: Edward H. Bittner, 87 Mungertown Rd., Madison, CT (US) 06443

( * ) Notice: Subject to any disclaimer, the term of this patent is extended or adjusted under 35 U.S.C. 154(b) by 0 days.

(21) Appl. No.: 10/923,063

(22) Filed: Aug. 20, 2004

(65) Prior Publication Data

US 2005/0039731 A1 Feb. 24, 2005

Related U.S. Application Data

(60) Provisional application No. 60/497,123, filed on Aug. 22, 2003.

(51) Int. Cl.[7] ..... F02P 5/00
(52) U.S. Cl. ..... 123/595
(58) Field of Search ..... 123/595, 613, 123/605, 621, 634, 635, 647, 406.58

(56) References Cited

U.S. PATENT DOCUMENTS 4,019,486 A * 4/1977 Siegle ..... 123/643
4,235,213 A * 11/1980 Jellissen ..... 123/146.5 A
4,395,999 A * 8/1983 McKechnie ..... 123/618
4,502,454 A * 3/1985 Hamai et al. ..... 123/406.65
5,144,936 A * 9/1992 Murata et al. ..... 123/655
5,651,352 A * 7/1997 Terakado et al. ..... 123/613
6,622,711 B1 * 9/2003 Skinner et al. ..... 123/634
6,712,052 B2 * 3/2004 Itoh ..... 123/647
6,882,259 B1 * 4/2005 Klocinski et al. ..... 336/90
2002/0078926 A1 * 6/2002 Kolossow et al. ..... 123/406.57

* cited by examiner

*Primary Examiner*—Hai Huynh
(74) *Attorney, Agent, or Firm*—Dale Lynn Carlson; Timothy J. Olson; Wiggin and Dana LLP

(57) ABSTRACT

An electronic ignition system for a vintage automobile includes an ignition coil and an electronic switching circuit disposed in a coil box of the vintage automobile. The coil and electronic switching circuit are mounted within a coil box module that replaces four original induction coils within the coil box. Once the coil box module is installed in the coil box, it is not detectible unless the cover on the coil box is removed. Wires from the original ignition system are utilized. A buzzer is also incorporated to simulate the sound of the vibrating switches on the original induction coils. A rotor and electronic sensor are installed within the original commutator cap, making them impossible to detect unless the commutator cap is removed.

37 Claims, 9 Drawing Sheets

ELECTRONIC IGNITION SYSTEM FOR VINTAGE AUTOMOBILES

CROSS-REFERENCE TO RELATED APPLICATION

This application claims the benefit of U.S. Provisional Patent Application No. 60/497,123, filed Aug. 22, 2003, which is incorporated by reference herein in its entirety.

BACKGROUND OF THE INVENTION

1. Field of the Invention

This invention relates to electronic ignition systems for automobiles. More particularly, this invention relates to electronic ignition systems for vintage automobiles.

2. Description of the Related Art

FIGS. 1–3 depict an ignition system 10 originally installed in vintage automobiles such as, for example, the Ford Model-T, and commonly known as the "High Tension Jump Spark System". As used herein, the term "vintage" is meant to include any automobile built between the years 1900 to 1930. The ignition system 10 includes the following main components: a commutator 12, induction coil assemblies 14, vibrating switches 16, spark plugs 18, high voltage wires 20, low voltage wires 22, and one or more power supply wires 24. Typically, the number of vibrating switches 16, induction coil assemblies 14, low voltage wires 22, and high voltage wires 20 is equal to the number of combustion cylinders in an associated internal combustion engine 26.

The commutator 12 is mounted to the internal combustion engine 26 and is electrically connected to primary windings in the induction coil assemblies 14 via the low voltage wires 22. As shown in FIG. 2, the commutator 12 includes a commutator cap 28 for receiving the four low-voltage wires 22. Each of the low-voltage wires 22 is electrically connected to a respective contact segment 30 in an internal rotary "raceway" 32 by threaded terminals 23. A roller contact 34 is mechanically coupled to, and rotates with, a cam shaft 36 of the engine 26. A fiber ring 33 electrically isolates the contact segments 30 from each other and from a steel outer housing 35 of the commutator cap 28.

As shown in FIG. 3, the induction coil assemblies 14 are mounted within a coil box 38, which is located within a passenger cabin of the automobile. Referring to FIGS. 1 and 3, the low voltage wires 22 are connected to terminals 40, which extend through a firewall of the vehicle and which are electrically connected to primary windings in each of the induction coil assemblies 14. The primary windings of each of the induction coil assemblies 14 are also electrically connected to a power supply device, such as a magneto, battery, or both, via terminals 42. A secondary winding within each of the induction coil assemblies 14 is electrically connected to a respective spark plug 18 via one high voltage wire 20. The spark plugs 18 are mounted within combustion cylinders in the internal combustion engine 26.

Mounted on the top of each of the coil assemblies 14 is a vibrating switch 16. Contact points of each vibrating switch 16 are electrically connected in a circuit containing the power source and the primary winding of the associated coil assembly 14.

In operation, the roller contact 34 is rotated by the cam shaft 36 of the engine 26, which causes the roller contact 34 to traverse around the raceway 32 and contact the contact segments 30 in an order corresponding to the firing sequence of the engine 26. The roller contact 34 remains in contact with each contact segment 30 for about 10 to 15 degrees of engine crankshaft rotation. When the roller contact 34 is in contact with the contact segment 30, the associated vibrating switch 16 is opened to collapse the magnetic field stored in the associated coil assembly 14, which induces electrical current in the secondary winding of the coil assembly 14. The electrical current induced in the secondary winding provides a voltage (about 8,000 to 20,000 volts) across a gap in an associated spark plug 18, which produces an arc for igniting fuel in the associated combustion cylinder.

While the ignition system 10 was successfully installed and operated in millions of vehicles, it was not without its faults. For example, the roller contact 34 within the commutator 12 and the contact points of the vibrating switches 16 are prone to wear. As these components become worn, engine operation becomes rough and inefficient, which can lead to premature failure of the engine.

The ignition system 10 is also known to provide some peculiar operating characteristics. For example, if a vehicle operator stops the engine with the roller contact 34 positioned on a contact segment 30 corresponding to a cylinder charged with fuel, the engine will re-start. In the Ford Model-T, for example, such re-starts are believed to occur as frequently as once every ten times the engine is stopped. Nonetheless, such re-starts are a surprise to the operator. Another peculiar operating feature of the ignition system 10 is the sound made by the vibrating switches 16, which, because the switches are mounted in the coil box 38 within the passenger cabin, can be heard by the vehicle's occupants.

Many advances in automotive ignition systems have been made in the years since the ignition system 10 was installed on new vehicles. The advance of electronic ignition systems has eliminated the need for many of the electrical contact points and moving parts found in the ignition system 10. As a result, modern electronic ignition systems provide for smoother running and more efficient engines that require much less maintenance.

Various kits are commercially available to replace the ignition system 10 with more advanced ignition systems. For example, a kit commercially available from Texas T Parts, 1820 Gray Stone Drive Bryan, Tex. provides a Kettering type ignition system for replacing the ignition system 10. In general, the Kettering type ignition system replaces the induction coil assemblies 14 with a single coil and replaces the vibrating switches 14 with a single master set of contact points connected to a condenser. A mechanical drive and housing associated with the contact points are mechanically coupled to the engine and, therefore, must be mounted in the engine compartment where they are plainly visible. As a result, such kits are not desirable to vintage automobile aficionados who wish to retain the automobile's original appearance.

Therefore, there remains a need for a replacement to the original ignition system in a vintage automobile that provides advances available in modern electronic ignition systems, while retaining the automobile's original appearance.

BRIEF SUMMARY OF THE INVENTION

The above and other needs are met by an electronic ignition system for an internal combustion engine in a vintage automobile. The electronic ignition system includes an ignition coil and an electronic switching circuit disposed in a coil box of the vintage automobile. The electronic switching circuit is configured to open an electrical circuit including a primary winding of the ignition coil in response to a signal indicative of a rotational position of a camshaft in the internal combustion engine. The electronic ignition system may include a buzzer disposed in the coil box for simulating the sound of vibrating switches. The electronic ignition system may include a housing containing the ignition coil and the electronic switching circuit. The housing includes a first plurality of electrical terminals disposed thereon, with the first plurality of electrical terminals being positioned to make electrical contact with a second plurality of electrical terminals disposed in the coil box when the housing is inserted into the coil box.

In one embodiment, the electronic ignition system includes an electronic sensor disposed proximate the camshaft. The electronic sensor is configured to provide the signal indicative of the rotational position of the camshaft, and may be selected from at least one of: a hall-effect sensor, an optical sensor, an eddy current killed oscillator, and a reluctor. The electronic sensor is preferably mounted within a commutator cap on the internal combustion engine, and may provide the signal indicative of the rotational position of the camshaft via a wire extending from the commutator cap to a terminal disposed on the coil box.

In another embodiment, a power supply circuit is disposed in the coil box. The power supply circuit is configured to provide operating power to the electronic sensor. Preferably, the operating power is provided from the power supply circuit to the electronic sensor via a second wire extending from the commutator cap to a second terminal disposed on the coil box.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

The invention will be more fully understood from the following detailed description taken in conjunction with the accompanying drawings wherein like elements are numbered alike, and in which.

DETAILED DESCRIPTION

Figure 1:
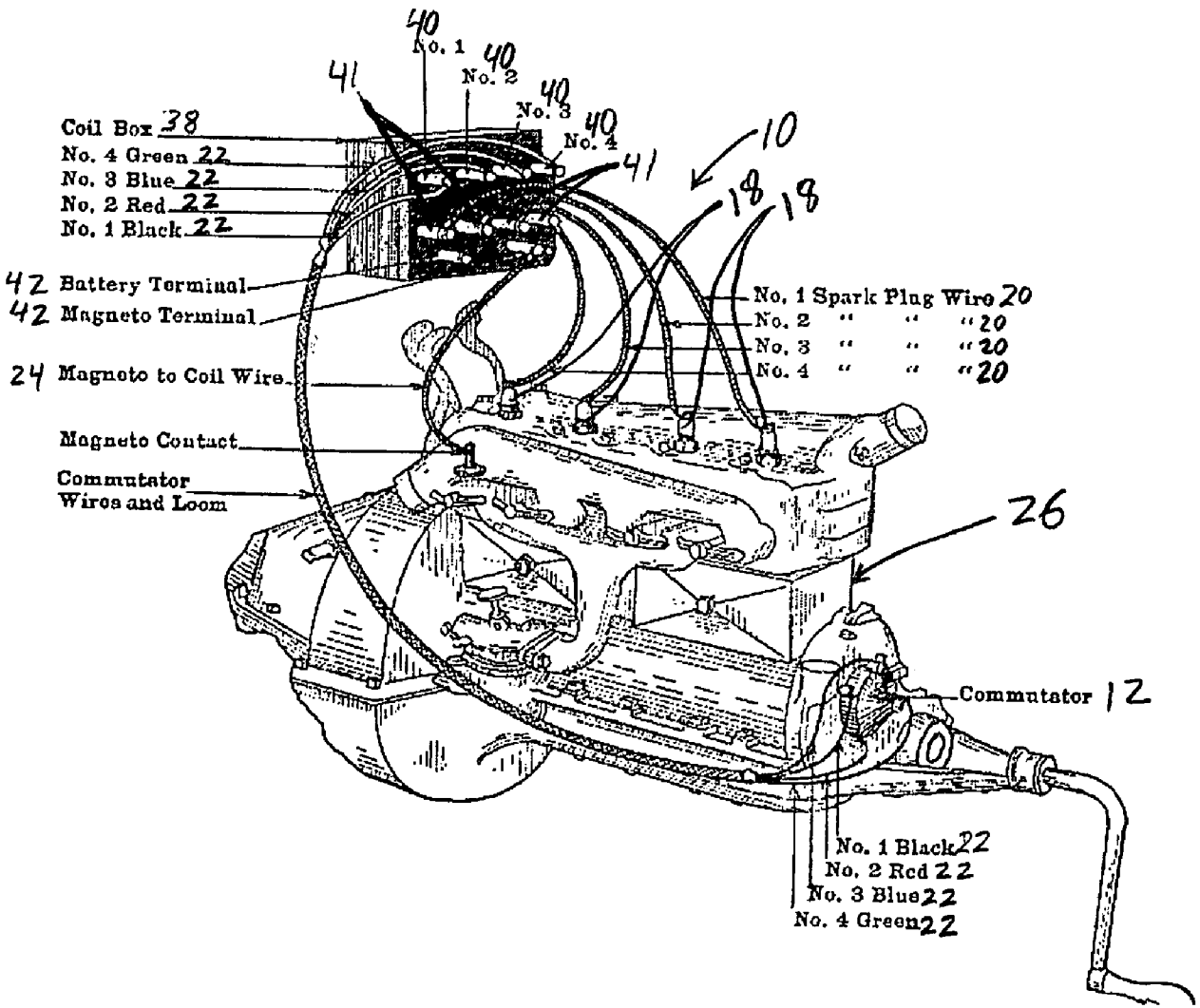
Fig. 1 (Prior Art)
FIG. 1 is a perspective view of an ignition system coupled to an internal combustion engine for a vintage automobile.
Figure 3:
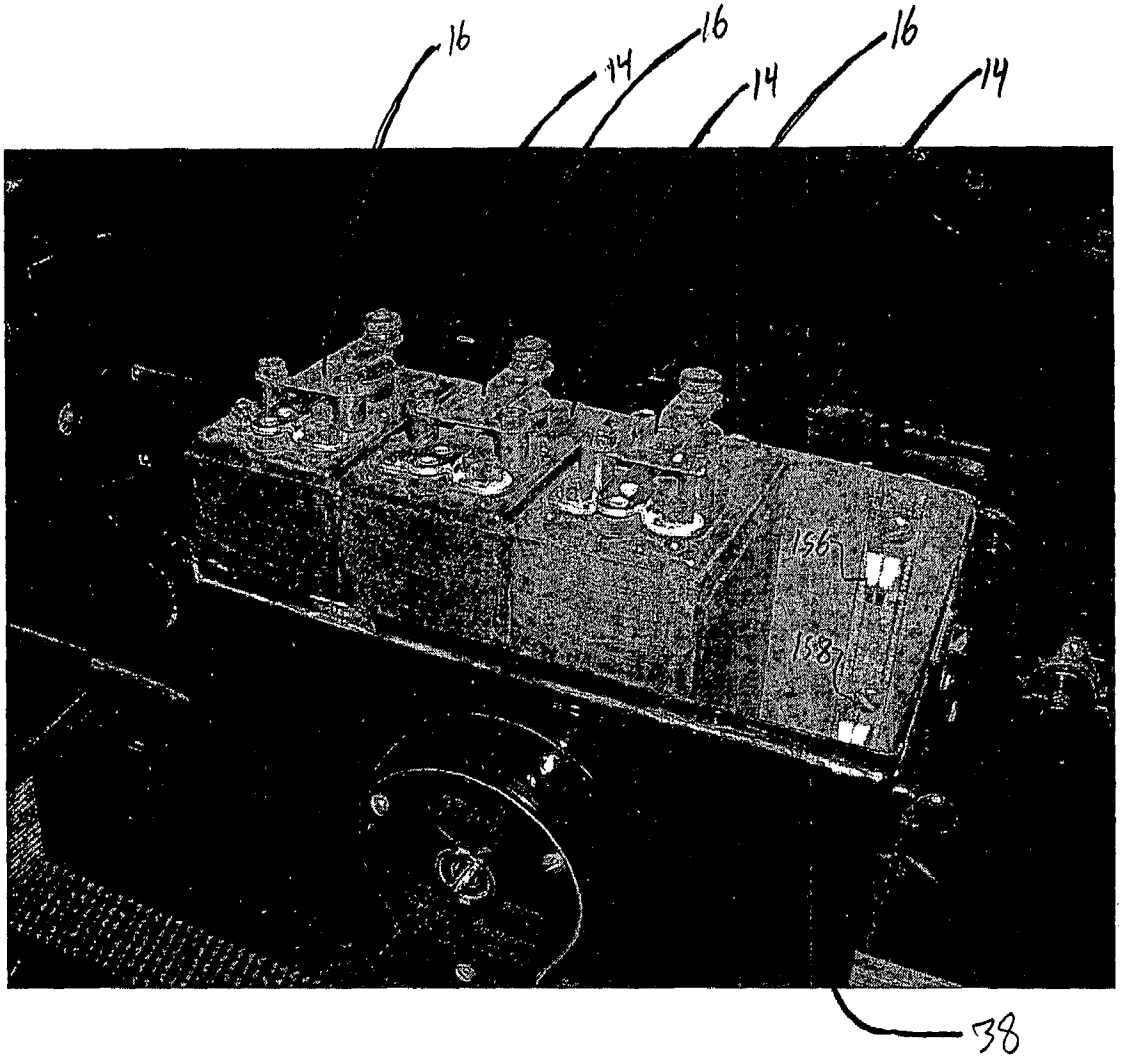
Fig. 3 (Prior Art)
FIG. 3 is a perspective view of a coil box with the cover removed to reveal three of four coil assemblies and their associated vibrating switches in the ignition system of FIG. 1.
Figure 4:
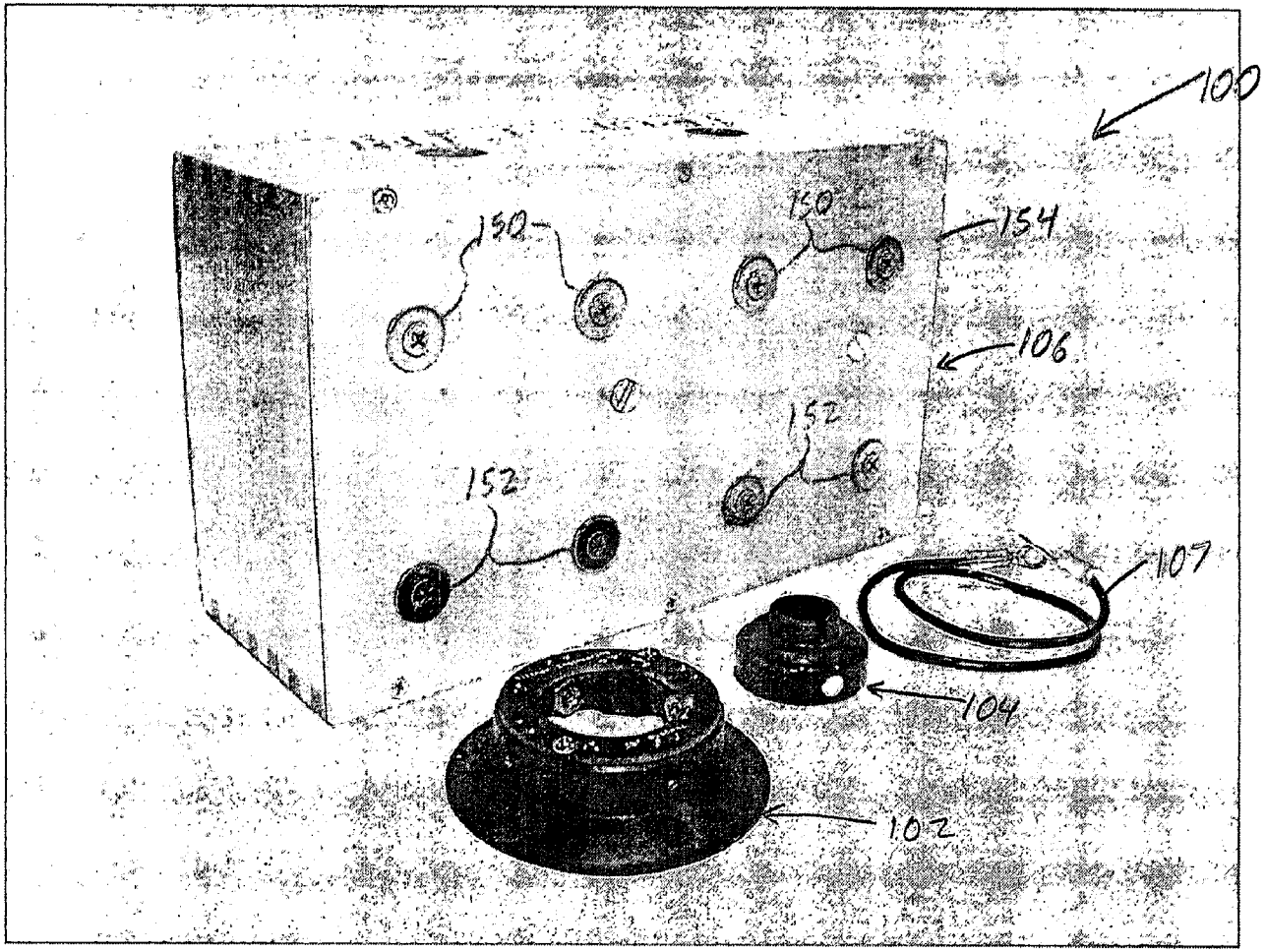
FIG. 4 is a perspective view of components of an electronic ignition system for a vintage automobile.

Referring to FIG. 4, a perspective view of the main components of an electronic ignition system 100 for a vintage automobile is shown. As used herein, the term "vintage" is meant to include any automobile built between the years 1900 to 1930. These main components include an electronic sensor 102, a rotor 104, and a coil box assembly 106, which may be provided as a kit for upgrading the original ignition system 10, described with reference to FIGS. 1–3, to an electronic ignition system. A ground wire 107 may also be provided in the kit. With reference to FIGS. 1 through 4, the electronic sensor 102 and rotor 104 replace the roller contact 34 of the original ignition system 10, and the coil box 106 assembly replaces the coil assemblies 14 and vibrating switches 16 of the original ignition system 10. The electronic sensor 102 and rotor 104 use the original commutator cap 28 of the commutator 12, and the coil box assembly 106 is disposed in the coil box 38 of the automobile. The high voltage, low voltage, and power supply wires 20, 22 and 24 from the original ignition system 10 may be used in the electronic ignition system 100, with supply power to the electronic sensor 102 being provided from the coil box assembly 106 via two of the low voltage wires 22, and timing signals from the electronic sensor 102 being provided to the coil box assembly 106 via the remaining two low voltage wires 22. With a cover to the coil box 38 closed, the electronic ignition system 100 appears as shown in FIG. 1. In other words, the electronic ignition system 100 provides an identical outward appearance to that of the original ignition system 10.

Figure 5:
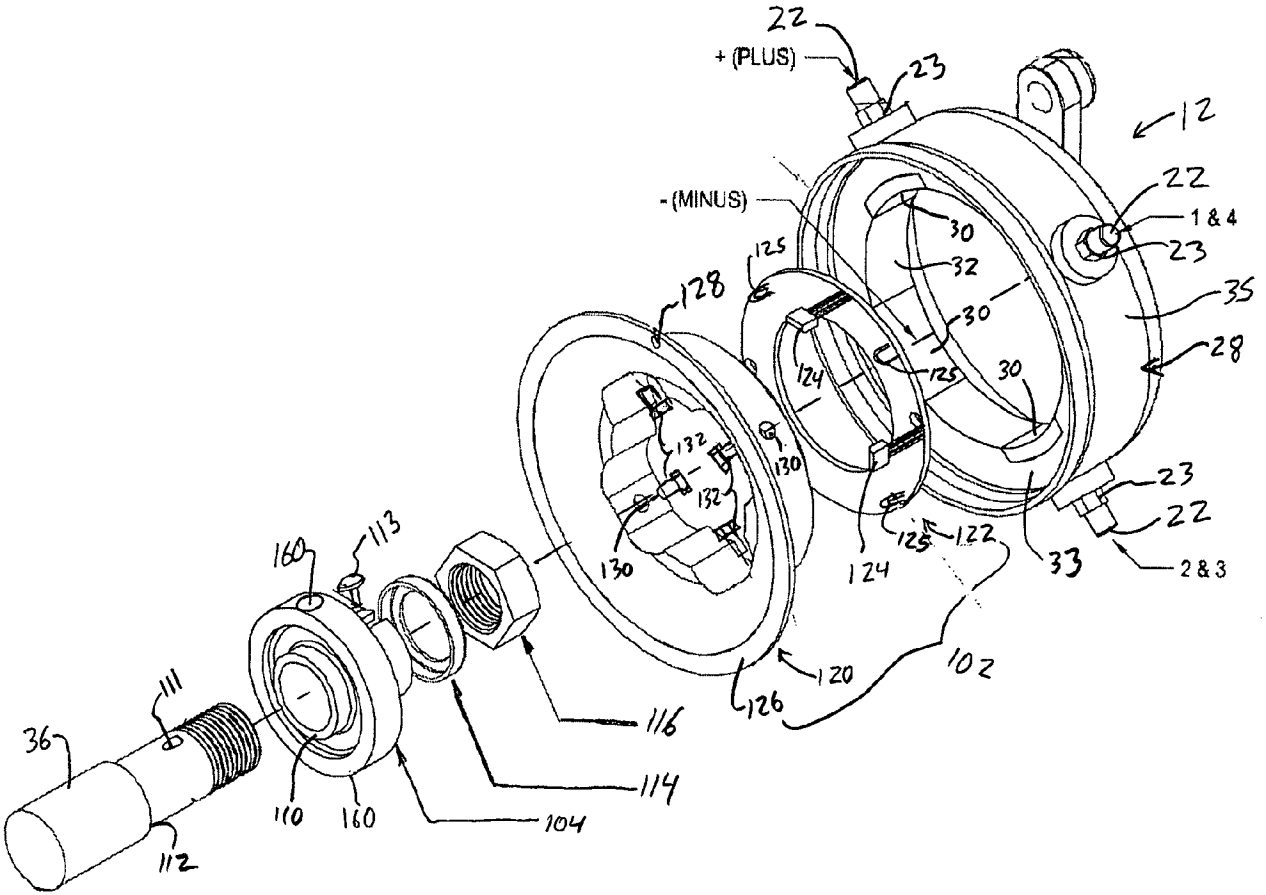
FIG. 5 is an exploded view of a commutator assembly of the electronic ignition system.

FIG. 5 is an exploded perspective view of the commutator 12 including the electronic sensor 102 and rotor 104. In the embodiment shown, the rotor 104 is a generally cylindrical structure, with a central aperture for receiving a threaded end of camshaft 36. A pair of magnets 160 (e.g., rare earth magnets) are disposed within the rotor 104 at diametrically opposed side surfaces of the rotor 104. One end of the rotor 104 forms a shoulder 110 for abutting with a shoulder 112 formed on the cam shaft 36. The cam shaft 36 may be modified to include an aperture 111, which receives a pin 113. The pin 113 is received in a slot disposed in the rotor 104 for locking the rotor 104 in place on the cam shaft 36. A retainer washer 114 is disposed around the camshaft 36 at an opposite end of the rotor 104, and a nut 116 is threaded on the end of the camshaft 36 to secure the rotor 104 against the shoulder 112 so that the rotor 104 and camshaft 36 rotate as one.

The electronic sensor 102 includes a support housing 120 and a printed circuit board 122 having sensors 124 and wire loops 125 extending therefrom. The support housing 120 is a generally cylindrical structure having a central aperture sized to receive the rotor 104 in concentric relationship and to allow the rotor 104 to rotate freely within the central aperture. The circuit board 122 is ring-shaped and is secured to one end of the support housing 120, which has slots disposed therein for receiving and protecting the sensors 124. A radial flange 126 extends around an opposite end of the support housing 120. The radial flange 126 may include a visual indicator mark 128 disposed thereon for visually aligning the support housing 120 with the commutator cap 28. Extending diametrically through the support housing 120 are four threaded apertures 130, which receive electrically conductive screws (e.g., setscrews) 132. The screws 132 are electrically connected to associated leads in the circuit board 122 by the wire loops 125. Each screw 132 extends through an associated wire loop 125, and a head on the screw 125 captures the wire loop 125 when the screw 125 is tightened onto the support housing 120. Preferably, the support housing 120 is formed from a rigid, electrically insulative material such as, for example, high temperature plastic.

The commutator cap 28 is a cup-shaped structure having threaded terminals 23 disposed around its circumference for receiving the four low-voltage wires 22. Within the cap 28, each of the low-voltage wires 22 is electrically connected to a respective contact segment 30 in the internal rotary raceway 32. The fiber ring 33 electrically isolates the contact segments 30 from each other and from a steel outer housing 35 of the cap 28. The raceway 32 forms an aperture, which receives the circuit board 122 and the end of the support housing 120.

Figure 2:
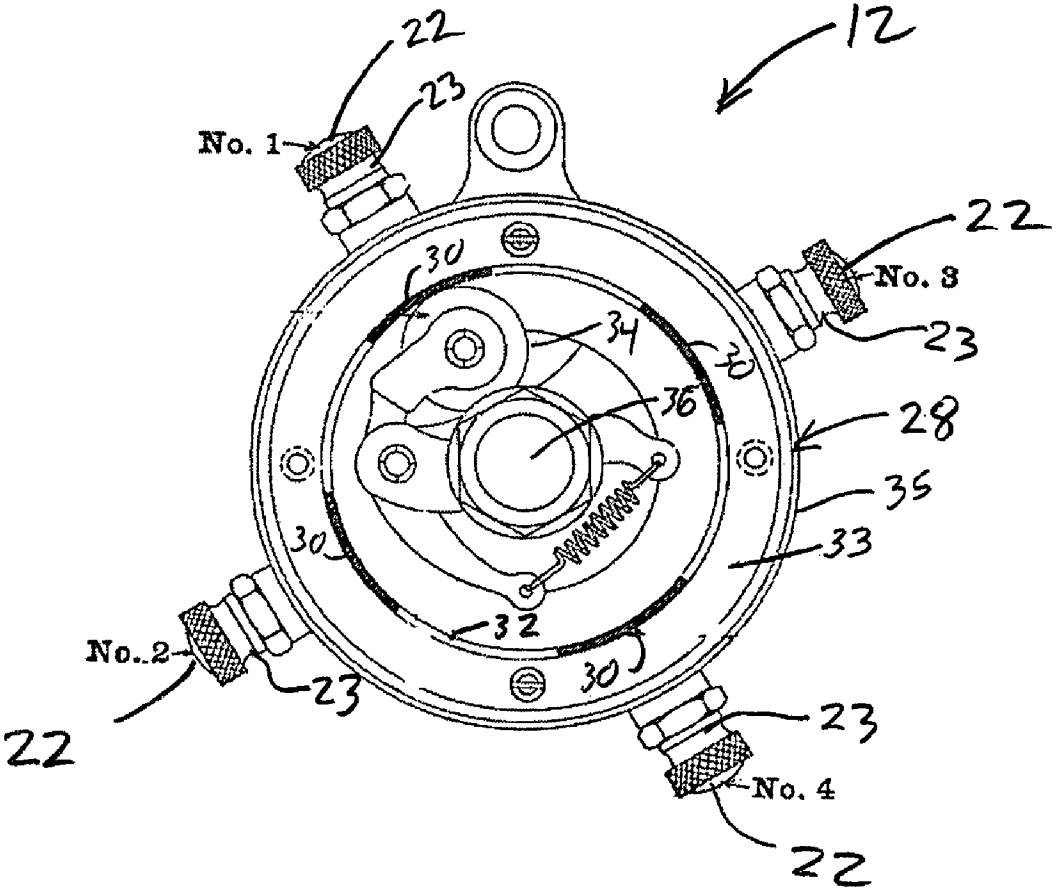
Fig. 2 (Prior Art)
FIG. 2 is an elevation view of a commutator in the ignition system of FIG. 1.

Installation of the rotor 104 and electronic sensor 102 is accomplished by removing the commutator cap 28 to expose the original roller contact 34 (FIG. 2). The nut 116, retainer 114, and roller contact 34 are then removed from the camshaft 36. The camshaft 36 may be drilled to form the aperture 111, and the pin 113 may be installed in the aperture 111. The rotor 104 is then installed on the camshaft 36 using the same nut 116 and retainer 114. The electronic 110 sensor 102, with the circuit board 122 mounted to the support housing 120, are inserted into the aperture formed by the raceway 32 such that the visual indicator mark 128 is aligned with a predetermined point on the cap 28. The flange 126 abuts against the face of the commutator cap 28 to ensure proper insertion depth of the support housing 120. With the electronic sensor 102 positioned within the cap 28, the screws 132, which are disposed through the associated 115 wire loops 125, are tightened onto the contact segments 30 to electrically connect the wire loops 125 on the circuit board 122 with the low voltage wires 22. The commutator cap 28 with installed electronic sensor 102 is then inserted over the rotor 104, and the commutator cap 28 is secured to the internal combustion engine 26 (FIG. 1).

Figure 6:
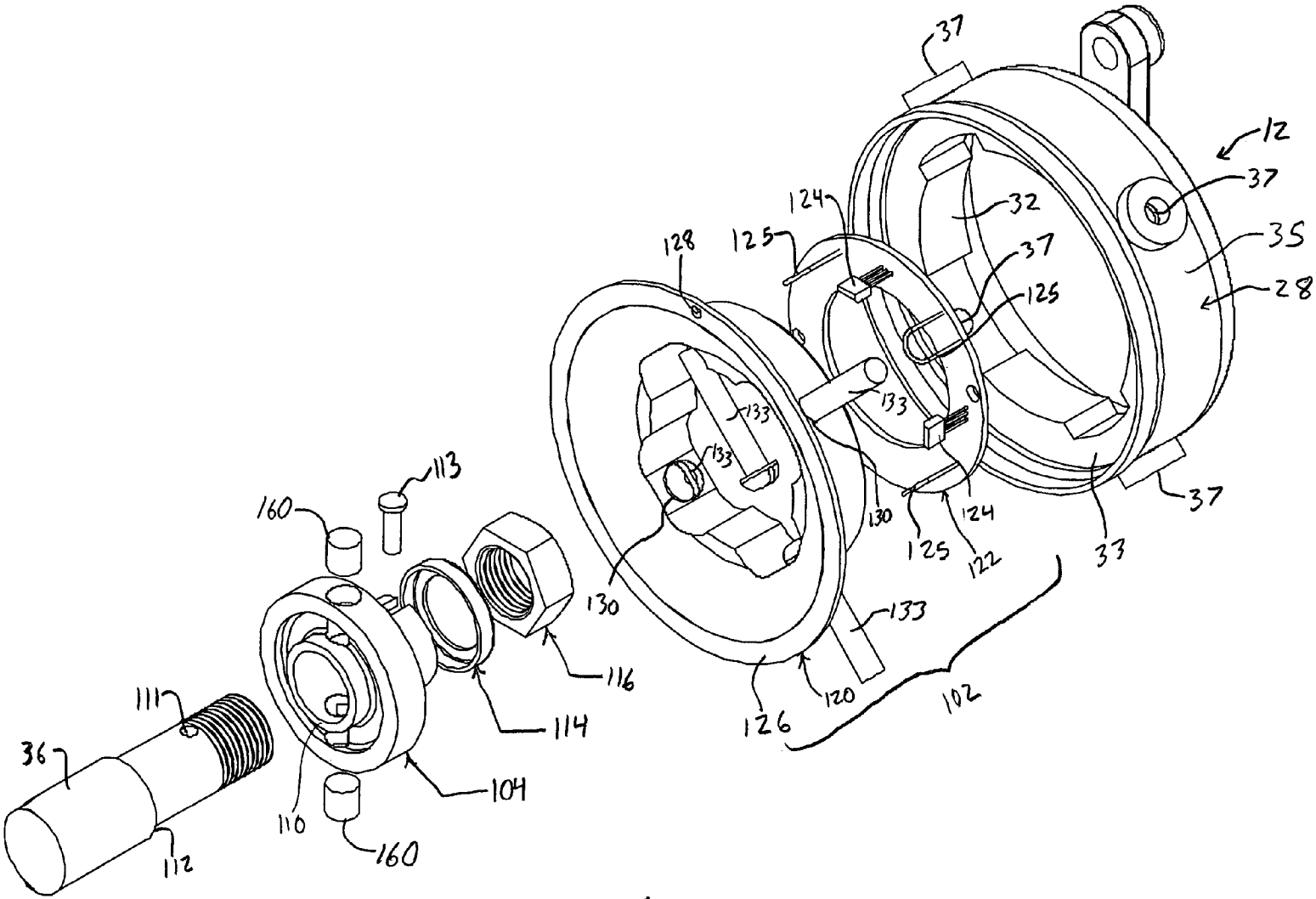
FIG. 6 is an exploded view of an alternative commutator assembly of the electronic ignition system.

FIG. 6 is an exploded perspective view of an alternative commutator 12 including the electronic sensor 102 and rotor 104. The commutator 12 of FIG. 6 is substantially similar to that shown is FIG. 5, with like items numbered alike. In the commutator 12 of FIG. 6, the segments 30 and associated threaded terminals 23 shown in FIG. 2 are removed, revealing apertures 37 in the commutator cap 28, which extend through the raceway 32 steel outer housing 35. Electrical conductors 133 (e.g. 10–32 brass screws) are disposed through the apertures 130 in the support housing 120. The conductors 133 extend through the wire loops 125 and through the apertures 37 in the commutator cap 12, where the conductors 133 can be coupled to the low voltage wires 22 (FIG. 1). The conductors 133 provide electrical connection between the circuit board 122 and the low voltage wires 22 via wire loops 125.

In the embodiment of FIG. 6, installation of the rotor 104 and electronic sensor 102 is accomplished by removing the commutator cap 28 to expose the original roller contact 34 (FIG. 2). The nut 116, retainer 114, and roller contact 34 are then removed from the camshaft 36. The camshaft 36 may be drilled to form the aperture 111, and the pin 113 may be installed in the aperture 111. The rotor 104 is then installed on the camshaft 36 using the same nut 116 and retainer 114. The segments 30 and associated threaded terminals 23 (FIG. 2) are removed from the commutator cap 28 to reveal apertures 37. The electronic sensor 102, with the circuit board 122 mounted to the support housing 120, are inserted into the aperture formed by the raceway 32 such that the visual indicator mark 128 is aligned with a predetermined point on the cap 28. The flange 126 abuts against the face of the commutator cap 28 to ensure proper insertion depth of the support housing 120. With the electronic sensor 102 positioned within the cap 28, the electrical conductors 133 are disposed through the associated wire loops 125, apertures 130, and apertures 37. The low voltage wires 22 (FIG. 1) are then coupled to the ends of the electrical conductors 133. The commutator cap 28 with installed electronic sensor 102 is then inserted over the rotor 104, and the commutator cap 28 is secured to the internal combustion engine 26 (FIG. 1).

In either of the embodiments of FIG. 5 and FIG. 6, the rotor 104 and electronic sensor 102 allow the troublesome roller contact 34 of the original ignition system 10 to be replaced using the original commutator cap 28, with the rotor 104 and electronic sensor 102 being visible only upon removal of the commutator cap 28.

Figure 7:
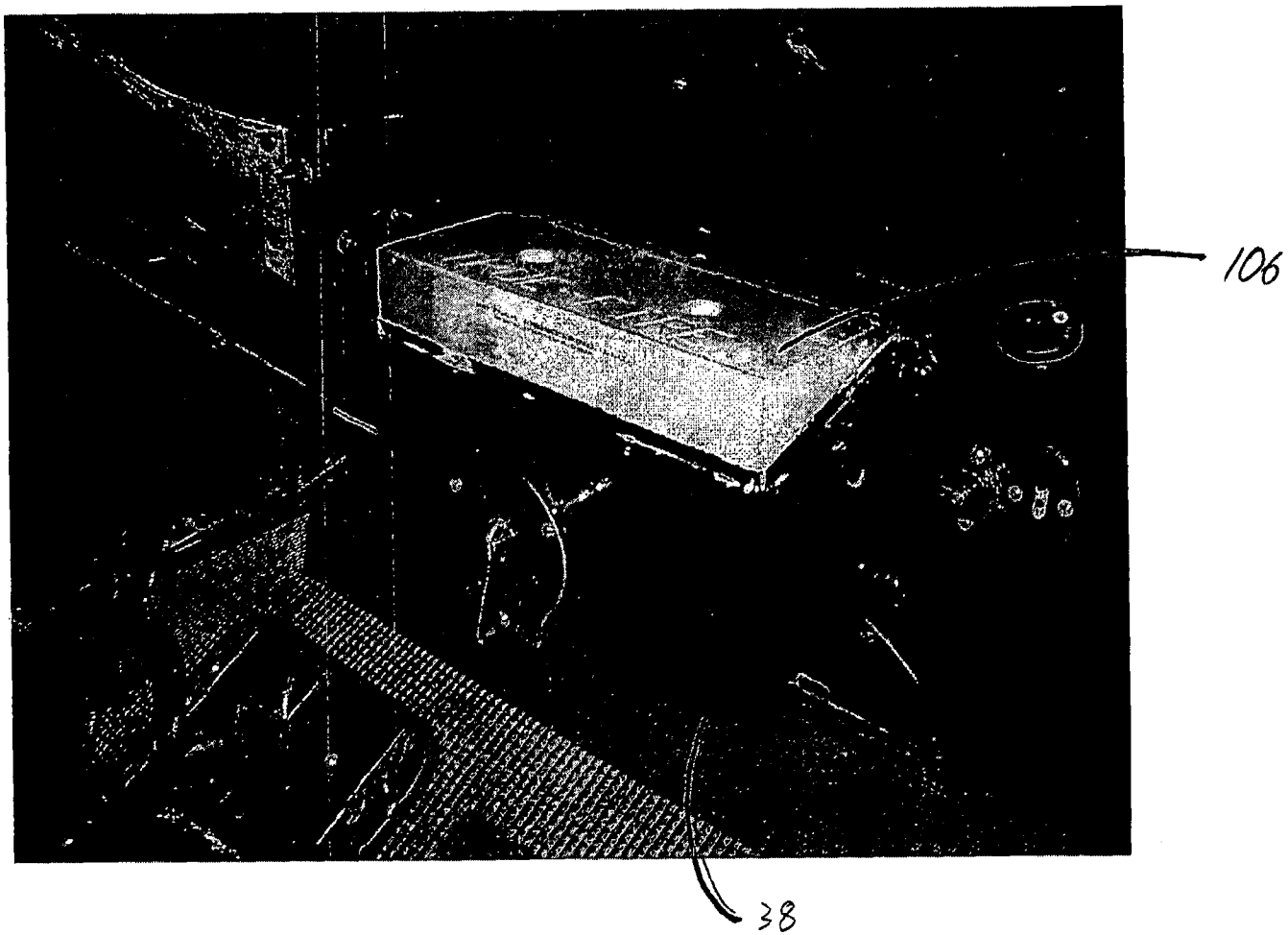
FIG. 7 is a perspective view of a coil box module of the electronic ignition system disposed in the coil box of the vintage automobile.

Referring again to FIG. 4, the coil box assembly 106 includes a plurality of electrical terminals 150 and 152 disposed along a wall of a housing 154. The housing 154 has the same dimensions as the plurality of coil assemblies 14 from the original ignition system 10, and is received in the coil box 38 in place of the assemblies 14, as shown in FIG. 7. Referring to FIG. 3, the coil box 38 includes a pair of flexible terminals 156 and 158 for each coil assembly 14. The flexible terminals 156 and 158 extend into the coil box 38, with the terminals 156 and 158 being electrically connected to terminals 40 and 41 (FIG. 1), respectively, which extend external to the coil box 38. Referring to FIGS. 1, 3, and 4, the terminals 150 and 152 disposed on the housing 154 are positioned to make electrical contact with the flexible terminals 156 and 158, respectively, when the coil box assembly 106 is inserted into the coil box 38. With the coil box assembly 106 inserted into the coil box 38, electrical connection between the coil box assembly 106 and the commutator 12 is made via the terminals 150, terminals 156, terminals 40 and low voltage wires 22. In addition, electrical connection is made between the coil box assembly 106 and the spark plugs 18, via the terminals 152, terminals 158, and the high voltage wires 20. Terminals (not shown) are also provided at the bottom of the housing 154 for electrically connecting to the power supply terminal 42 via terminals (not shown) disposed at the bottom of the coil box 38. The grounding wire 107 may be electrically connected between one of the terminals 40 and a grounding point on the automobile.

The coil box assembly 106 allows the troublesome coils 14 and vibrator switches 16 of the original ignition system 10 to be replaced with electronic components simply by removing the old coil assemblies 14 and vibrator switches 16, and inserting the coil box assembly 106 in its place. Inserting the coil box assembly 106 into the coil box 38 makes the necessary electrical connections, and no alteration of the coil box 38 is necessary. The modification of the original ignition system 10 is not visible unless a lid to the coil box 38 is removed to reveal the coil box assembly 106. It is contemplated that the housing 154 of the coil box assembly 106 may be modified to include non-working vibration switches to further retain the automobile's original appearance.

With the installation of the rotor 104, electronic sensor 102, coil box assembly 106, and grounding wire 107, the electronic ignition system 100 is fully operational. This installation is performed without any modification to the wiring of the automobile, and without any change to the outward appearance shown in FIG. 1.

Figure 8:
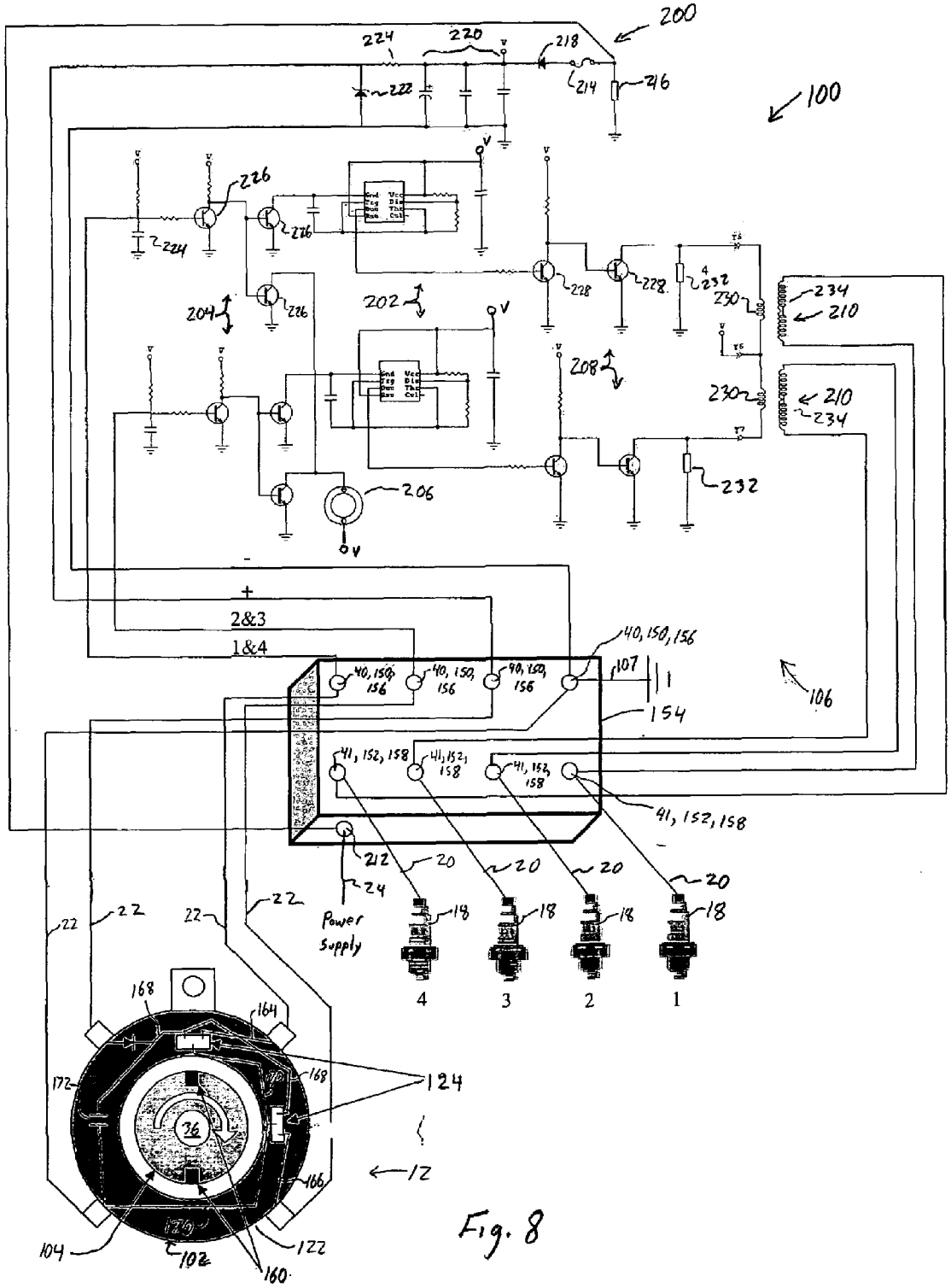
FIG. 8 is a schematic diagram of the electronic ignition system installed in the vintage automobile.

Referring to FIG. 8, a schematic diagram of the electronic ignition system 100 installed in the vintage automobile is shown. In the embodiment shown, the rotor 104 includes the pair of magnets 160 disposed at diametrically opposed side surfaces of the rotor 104. The electronic sensor 102 includes a pair of hall-effect sensors 124 disposed proximate the inside diameter of the circuit board 122 and spaced at 90° relative to a center of rotation of the camshaft 36. One trace 164 formed on the circuit board 122 electrically connects the output of one hall-effect sensor 124 with one low-voltage wire 22 (via a wire loop 125, a screw 132 and contact segment 30 as shown in FIG. 5, or via a wire loop 125 and a conductor 133 as shown in FIG. 6). Similarly, another trace 166 formed on the circuit board 122 electrically connects the output of the other hall-effect sensor 124 with another low-voltage wire 22 (via a wire loop 125, a screw 132 and contact segment 30 as shown in FIG. 5, or via a wire loop 125 and a conductor 133 as shown in FIG. 6). Power is supplied to the hall-effect sensors 124 via traces 168 formed on the circuit board 122, which are electrically connected to a low-voltage wire 22 (via a wire loop 125, a screw 132 and contact segment 30 as shown in FIG. 5, or via a wire loop 125 and a conductor 133 as shown in FIG. 6). The hall-effect sensors 124 are connected to ground via traces 170 formed on the circuit board 122, which are electrically connected to a low-voltage wire 22 (via a wire loop 125, a screw 132 and contact segment 30 as shown in FIG. 5, or via a wire loop 125 and a conductor 133 as shown in FIG. 6). A capacitance 172 may be provided between the power supply trace 168 and ground trace 170 to filter electrical noise from the electrical power provided to the hall-effect sensors 124.

As the camshaft 36 and rotor 104 rotates, the electronic sensor 102 senses the rotational position of the camshaft 36 and rotor 104, and provides signals indicative of this rotational position to the coil box assembly 106. More specifically, as the camshaft 36 rotates, the magnets 160 move past each of the hall-effect sensors 124. As each magnet 160 moves past a hall-effect sensor 124, that hall-effect sensor 124 provides an output signal to the coil box assembly 106.

While the embodiment shown uses magnets 160 in the rotor 104 and hall-effect sensors 124 in the electronic sensor 102, it is contemplated that any type of electronic sensor that fits within the original commutator cap 28 and provides output signals indicative of the rotational position of the camshaft 36 may be used as sensor 124. For example, optical sensors may be used wherein, for example, a light sensor mounted on the circuit board 122 is triggered by light passing through slots formed in a flange mounted to the rotor 104. In other examples, eddy current killed oscillator (ECKO) type sensors or reluctors may be used in lieu of the hall-effect sensors 162. It will be appreciated that for certain types of sensors, an external power supply is not required. In this case, less than all of the wires 22 may be necessary for operation of the electronic ignition system 100. If less than all of the wires 22 are necessary, the screw 132 or conductor 133 associated with the unnecessary wire(s) 22 may be removed or replaced by a non-conductive device, thus leaving the unnecessary wire(s) 22 in place to retain the original appearance shown in FIG. 1.

Disposed within the housing 154 of the coil box assembly 106 is a power supply circuit 200, a pair of oscillator circuits 202, first switching circuits 204, a buzzer (sound generating device) 206, second switching circuit 208, and a pair of dry ignition coils 210. The power supply circuit 200 is electrically connected to the power supply (the magneto, battery or both) via a terminal 212 disposed on the bottom of the housing 154. The power supply circuit 200 is electrically connected to ground via the grounding wire 107, which may be connected between a terminal 40 and a grounding point on the frame of the automobile where the wire 107 can be hidden from view (e.g., under a hood former on the car). Alternatively, the grounding wire 107 may be moved or eliminated, with electrical ground made at any other inconspicuous point on the automobile. For example, electrical ground may be made at the commutator 12.

In the power supply circuit 200, overcurrent protection is provided by an inline fuse 214, and surge protection is by metal oxide varistor (MOV) 216 coupled between the input voltage and ground. A diode 218 rectifies the input voltage, various capacitors 220 filter the input voltage, and a zener diode 222 and resistor 224 are arranged to regulate the output voltage of the power supply circuit 200 to a predetermined value.

Each first switching circuit 204 is formed from NPN transistors 226, one of which has a base arranged to receive output signals from a hall-effect sensor 162. The output signal from each hall-effect sensor 162 may be filtered by a grounded capacitance 224. In response to receiving the output signal, the switching circuit 204 directs operating power to the buzzer 206. The buzzer 206 provides a sound that mimics the sound of the vibrating switches 16 found in the original ignition system 10 (FIG. 3), thus making the replacement electronic ignition system 100 audibly indistinguishable from the original system. Also in response to receiving the output signal, each switching circuits 204 activates a corresponding oscillator circuit 202.

Each oscillator circuit 202 includes an integrated circuit (IC) chip (e.g., a 555 Timer IC) arranged to provide an output signal of predetermined duration in response to activation by the switching circuit 204. In response to the output signal from the oscillator circuit 202, the second switching circuit 208 formed by NPN transistors 228 opens and closes a circuit including the primary winding 230 of an associated coil 210. The transistors 228 of the switching circuit 208 are protected from surges in the input voltage by a grounded MOV 232.

When the circuit including the primary winding 230 of each coil 210 is opened, the magnetic field induced by the primary winding 230 collapses, which in turn induces electrical current in a secondary winding 234 of the coil 210. Each secondary winding 234 is electrically connected across two spark plugs 18. The electrical current induced in the secondary winding 234 provides a voltage (about 8,000 to 40,000 volts) across gaps in the spark plugs 18, which produces an arc across the gaps to ignite any fuel in the associated combustion cylinders of the internal combustion engine 26 (FIG. 1).

In the embodiment shown, a spark is generated simultaneously in two cylinders. Therefore, the cylinders associated with each coil 210 are selected such that only one of the two cylinders is charged with fuel at the time of the spark. For example, in the four-cylinder engine shown in FIG. 1, the spark plugs 18 associated with cylinders 1 and 4 may share a coil 210, while the spark plugs 18 associated with cylinders 2 and 3 may share a coil 210. Because these cylinders share the same coil 210, they accordingly share the same hall-effect sensor 124, oscillator circuit 202, and switching circuits 204 and 208, which are used to activate the shared coil 210.

The replacement electronic ignition system 100 produces a continuous spark at one pair of spark plugs 18 as long as a magnet 160 is positioned proximate a hall-effect sensor 124. As a result, the electronic ignition system 100 provides the re-start characteristic associated with the original ignition system 10. In other words, if a vehicle operator stops the engine such that one of the magnets 160 is positioned proximate a hall-effect sensor 124 corresponding to a cylinder charged with fuel, the associated spark plugs 18 will spark and the engine will re-start.

Figure 9:
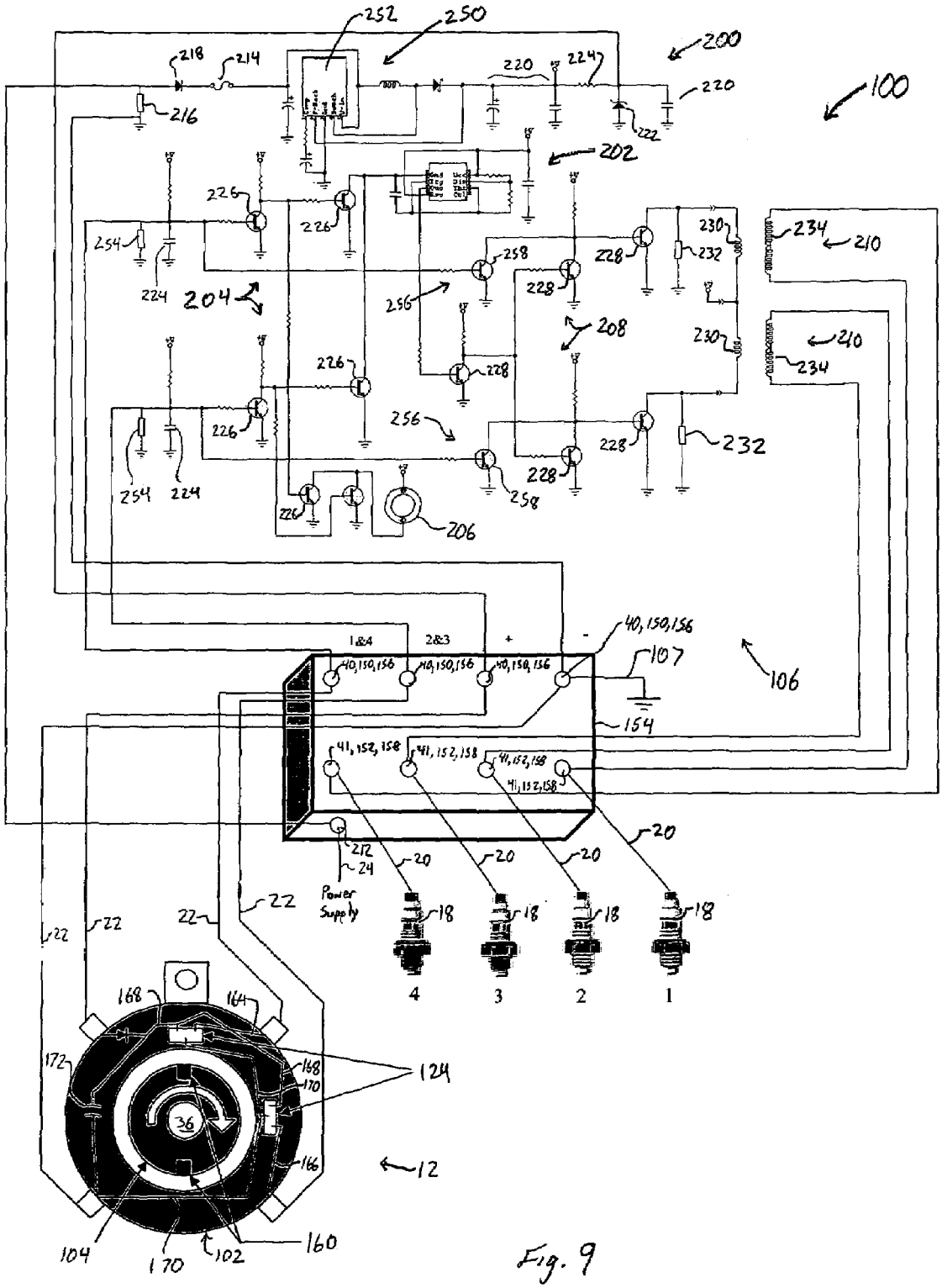
FIG. 9 is a schematic diagram of an alternative configuration of the electronic ignition system installed in the vintage automobile.

Referring to FIG. 9, a schematic diagram of an alternative configuration of the electronic ignition system 100 is shown. The embodiment of FIG. 9 is arranged and operates substantially the same as the embodiment of FIG. 8, with like features being numbered alike and differences being discussed below. In the embodiment of FIG. 9, the voltage power supply circuit 200 includes a voltage regulation circuit 250 that allows the use of a 6 volt to 12 volt power supply. The voltage regulation circuit 250 is arranged as a boost regulator circuit employing a simple step-up voltage regulator 252. In the embodiment of FIG. 9, the switching circuits 204 are protected from surges in the signal received from the hall-effect sensors 162 by grounded MOVs 254.

Also in the embodiment of FIG. 9, a single oscillator circuit 202 is used for both first switching circuits 204 and both second switching circuits 208. The oscillator circuit 202 includes an integrated circuit (IC) chip (e.g., a 555 Timer IC) arranged to provide an output signal of predetermined duration to both switching circuits 208 in response to activation by either switching circuit 204. To prevent simultaneous actuation of both switching circuits 208, third switching circuits 256 have been added. Switching circuits 256 each comprise an NPN transistor 258 having its base arranged to receive an output signal from a respective hall-effect sensor 124. In response to the output signal from its respective hall-effect sensor 124, each NPN transistor 258 enables and disables its respective switching circuit 204 by opening and closing a circuit including the base of a transistor 228 in the respective switching circuit 204. As previously discussed, the transistor 228 opens and closes a circuit including the primary winding 230 of an associated coil 210.

The electronic ignition system 100 described herein eliminates the troublesome roller contact found in the original ignition system 10 of vintage automobiles. The rotor and electronic sensor are installed within the original commutator cap, making them impossible to detect unless the commutator cap is removed. The troublesome induction coils are also eliminated and substituted with a modern dry ignition coil controlled by an electronic circuit, which produces a continuous spark at the spark plugs as long as the rotor and electronic sensor are positioned to close the circuit. This continuous spark is much like the original spark created by the old induction coils. A buzzer is also incorporated to simulate the sound of the vibrating switches on the original induction coils. The new dry coil and electronic circuit are mounted within a coil box module that replaces the four original induction coils within the coil box. Once the coil box module is installed in the coil box, it is not detectible unless the cover on the coil box is removed. The wires from the original ignition system are utilized and undisturbed. This new concept provides the best of modern ignition technology causing the internal combustion engine to run smoothly while at the same time preserving the original appearance and sound of the car.

A number of embodiments of the present invention have been described. Nevertheless, it will be understood that various modifications may be made without departing from the spirit and scope of the invention. Accordingly, other embodiments are within the scope of the following claims.

What is claimed is:

1. An electronic ignition system for an internal combustion engine in a vintage automobile, the electronic ignition system comprising:

a plurality of ignition coils disposed in a coil box of the vintage automobile in place of a plurality of induction coil assemblies having vibrating switches; and at least one electronic switching circuit disposed in the coil box, each electronic switching circuit opens an electrical circuit including a primary winding of at least one of the ignition coils in response to a signal indicative of a rotational position of a camshaft in the internal combustion engine.

2. The electronic ignition system of claim 1, further comprising:

a housing containing the ignition coils and the electronic switching circuit, the housing including a first plurality of electrical terminals disposed thereon, the first plurality of electrical terminals being positioned to make electrical contact with a second plurality of electrical terminals disposed in the coil box when the housing is inserted into the coil box, thereby making electrical connection between the ignition coils and spark plugs in the internal combustion engine.

3. The electronic ignition system of claim 1, further comprising:

an electronic sensor disposed proximate the camshaft, the electronic sensor provides the signal indicative of the rotational position of the camshaft.

4. The electronic ignition system of claim 3, wherein the electronic sensor is mounted within a commutator cap on the internal combustion engine.

5. The electronic ignition system of claim 4, wherein the electronic sensor provides the signal indicative of the rotational position of the camshaft via a wire extending from the commutator cap to a terminal disposed on the coil box.

6. The electronic ignition system of claim 5, wherein the electronic sensor is disposed in an aperture formed by a rotary contact raceway in the commutator cap, the rotary contact raceway including a plurality of contact segments formed thereon, and the electronic sensor is electrically connected to the wire via one of the contact segments.

7. The electronic ignition system of claim 5, wherein the electronic sensor is disposed in an aperture formed by a rotary contact raceway in the commutator cap, and the electronic sensor is electrically connected to the wire by a conductor extending through an aperture in the rotary contact raceway.

8. The electronic ignition system of claim 3, wherein the electronic sensor is selected from at least one of: a hall-effect sensor, an optical sensor, an eddy current killed oscillator, and a reluctor.

9. The electronic ignition system of claim 3, further comprising:

a power supply circuit disposed in the coil box, the power supply circuit provides operating power to the electronic sensor.

10. The electronic ignition system of claim 9, wherein the electronic sensor is mounted within a commutator cap on the internal combustion engine, the electronic sensor provides the signal indicative of the rotational position of the camshaft via a first wire extending from the commutator cap to a first terminal disposed on the coil box, and the operating power is provided from the power supply circuit to the electronic sensor via a second wire extending from the commutator cap to a second terminal disposed on the coil box.

11. The electronic ignition system of claim 1, further comprising:

a buzzer disposed in the coil box for simulating the sound of the vibrating switches.

12. The electronic ignition system of claim 1, wherein each ignition coil is electrically connected to two spark plugs in the internal combustion engine to induce a spark across a gap in each of the two spark plugs.

13. A kit for providing electronically controlled ignition in an internal combustion engine of a vintage automobile having a coil box configured to receive induction coil assemblies having vibrating switches, the kit including:

an electronic sensor configured to provide a signal indicative of a rotational position of a camshaft of the internal combustion engine;

a housing including a first plurality of electrical terminals disposed thereon, the first plurality of electrical terminals being positioned to make electrical contact with a second plurality of electrical terminals disposed in the coil box when the housing is inserted into the coil box in place of the induction coil assemblies and the vibrating switches;

a plurality of ignition coils disposed in the housing, each ignition coil including a secondary winding electrically connected to a terminal in the first plurality of electrical terminals;

at least one electronic switching circuit disposed in the housing, each electronic switching circuit being configured to open an electrical circuit including a primary winding of at least one of the ignition coils in response to the signal indicative of the rotational position of the camshaft.

14. The kit of claim 13, wherein the electronic sensor is mounted within a commutator cap on the internal combustion engine.

15. The kit of claim 14, wherein the electronic sensor provides the signal indicative of the rotational position of the camshaft to a terminal disposed on the coil box via a wire extending from the commutator cap to the terminal.

16. The kit of claim 15, wherein the electronic sensor is disposed in an aperture formed by a rotary contact raceway in the commutator cap, the rotary contact raceway including a plurality of contact segments formed thereon, and the electronic sensor is electrically connected to the wire via one of the contact segments.

17. The kit of claim 15, wherein the electronic sensor is disposed in an aperture formed by a rotary contact raceway in the commutator cap, and the electronic sensor is electrically connected to the wire by a conductor extending through an aperture in the rotary contact raceway.

18. The kit of claim 13, wherein the electronic sensor is selected from at least one of: a hall-effect sensor, an optical sensor, an eddy current killed oscillator, and a reluctor.

19. The kit of claim 13, further comprising:

a power supply circuit disposed in the coil box, the power supply circuit being configured to provide operating power to the electronic sensor.

20. The kit of claim 19, wherein the electronic sensor is mounted within a commutator cap on the internal combustion engine, the electronic sensor provides the signal indicative of the rotational position of the camshaft via a first wire extending from the commutator cap to a first terminal disposed on the coil box, and the operating power is provided from the power supply circuit to the electronic sensor via a second wire extending from the commutator cap to a second terminal disposed on the coil box.

21. The kit of claim 13, further comprising:

a buzzer disposed in the housing for simulating the sound of the vibrating switches.

22. The kit of claim 13, wherein the coil is electrically connected to two spark plugs in the internal combustion engine to induce a spark across a gap in each of the two spark plugs.

23. A vintage automobile comprising:

a coil box configured to receive induction coil assemblies having vibrating switches;

an internal combustion engine; and an electronic ignition system, the electronic ignition system including:

a housing disposed in the coil box in place of the induction coil assemblies and vibrating switches, the housing including a first plurality of electrical terminals disposed thereon, the first plurality of electrical terminals being positioned to make electrical contact with a second plurality of electrical terminals disposed in the coil box when the housing is inserted into the coil box;

a plurality of ignition coils disposed in the housing; and at least one electronic switching circuit disposed in the housing, each electronic switching circuit opens an electrical circuit including a primary winding of at least one of the ignition coils in response to a signal indicative of a rotational position of a camshaft in the internal combustion engine.

24. The vintage automobile of claim 23, wherein the electronic ignition system further includes:

an electronic sensor disposed proximate the camshaft, the electronic sensor provides the signal indicative of the rotational position of the camshaft.

25. The vintage automobile of claim 24, wherein the electronic sensor is mounted within a commutator cap on the internal combustion engine.

26. The vintage automobile of claim 25, wherein the electronic sensor provides the signal indicative of the rotational position of the camshaft via a wire extending from the commutator cap to a terminal disposed on the coil box.

27. The vintage automobile of claim 26, wherein the electronic sensor is disposed in an aperture formed by a rotary contact raceway in the commutator cap, the rotary contact raceway including a plurality of contact segments formed thereon, and the electronic sensor is electrically connected to the wire via one of the contact segments.

28. The vintage automobile of claim 26, wherein the electronic sensor is disposed in an aperture formed by a rotary contact raceway in the commutator cap, and the electronic sensor is electrically connected to the wire by a conductor extending through an aperture in the rotary contact raceway.

29. The vintage automobile of claim 24, wherein the electronic sensor is selected from at least one of: a hall-effect sensor, an optical sensor, an eddy current killed oscillator, and a reluctor.

30. The vintage automobile of claim 24, wherein the electronic ignition system further includes:

a power supply circuit disposed in the coil box, the power supply circuit provides operating power to the electronic sensor.

31. The vintage automobile of claim 30, wherein the electronic sensor is mounted within a commutator cap on the internal combustion engine, the electronic sensor provides the signal indicative of the rotational position of the camshaft via a first wire extending from the commutator cap to a first terminal disposed on the coil box, and the operating power is provided from the power supply circuit to the electronic sensor via a second wire extending from the commutator cap to a second terminal disposed on the coil box.

32. The vintage automobile of claim 23, further comprising:

a buzzer disposed in the coil box for simulating the sound of the vibrating switches.

33. The vintage automobile of claim 23, wherein each ignition coil is electrically connected to two spark plugs in the internal combustion engine to induce a spark across a gap in each of the two spark plugs.

34. A method of installing an electronic ignition system in a vintage automobile having an internal combustion engine, the method comprising:

replacing a plurality of coil assemblies and vibrating switches in a coil box of the vintage automobile with a housing containing a plurality of ignition coils, at least one electronic switching circuit, and a power supply circuit, each electronic switching circuit opens an electrical circuit including a primary winding of at least one of the ignition coils in response to a signal indicative of a rotational position of a camshaft in the internal combustion engine; and replacing a roller in a commutator cap on the internal combustion engine with an electronic sensor, the electronic sensor being disposed in an aperture formed by a rotary contact raceway in the commutator cap, the electronic sensor provides the signal indicative of the rotational position of the camshaft.

35. The method of claim 34, wherein the housing further contains:

a buzzer simulating the sound of the vibrating switches in the coil assemblies.

36. An electronic ignition system for a vintage automobile having an internal combustion engine, the electronic ignition system comprising:

a housing for replacing a plurality of coil assemblies having vibrating switches in a coil box of the vintage automobile, the housing containing a plurality ignition coils, at least one electronic switching circuit, and a power supply circuit, each electronic switching circuit opens an electrical circuit including a primary winding of at least one of the ignition coils in response to a signal indicative of a rotational position of a camshaft in the internal combustion engine, the housing includes a first plurality of electrical terminals disposed thereon, the first plurality of electrical terminals being positioned to make electrical contact with a second plurality of electrical terminals disposed in the coil box when the housing is inserted into the coil box; and an electronic sensor for replacing a roller in a commutator cap on the internal combustion engine, the electronic sensor being disposed in an aperture formed by a rotary contact raceway in the commutator cap, the electronic sensor provides the signal indicative of the rotational position of the camshaft via a first conductor extending from the commutator cap to a first terminal in the second plurality of electrical terminals disposed on the coil box, operating power is provided from the power supply circuit to the electronic sensor via a second conductor extending from the commutator cap to a second terminal in the second plurality of electrical terminals disposed on the coil box, and each ignition coil is electrically connected to at least one spark plug in the internal combustion engine via a third conductor electrically connected to a third terminal in the second plurality of electrical terminals disposed on the coil box.

37. The electronic ignition system of claim 36, wherein the housing further contains:

a buzzer simulating the sound of the vibrating switches in the coil assemblies.

* * * * *